US007607663B2

(12) United States Patent
Sugiyama

(10) Patent No.: US 7,607,663 B2
(45) Date of Patent: Oct. 27, 2009

(54) RECORDING MEDIUM TRANSPORT DEVICE AND IMAGE FORMING APPARATUS

(75) Inventor: Wataru Sugiyama, Hazu-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 484 days.

(21) Appl. No.: 10/879,011

(22) Filed: Jun. 30, 2004

(65) Prior Publication Data

US 2005/0035992 A1 Feb. 17, 2005

(30) Foreign Application Priority Data

Jun. 30, 2003 (JP) ..... 2003-187816

(51) Int. Cl.
*B65H 29/20* (2006.01)

(52) U.S. Cl. ..... 271/314; 271/274

(58) Field of Classification Search ..... 271/314, 271/274, 275, 264

See application file for complete search history.

(56) References Cited

U.S. PATENT DOCUMENTS

| | | | | |
|---|---|---|---|---|
| 5,441,354 | A * | 8/1995 | Broder et al. | 400/636.3 |
| 5,540,427 | A * | 7/1996 | Nitta et al. | 271/274 |
| 5,580,042 | A * | 12/1996 | Taniguro et al. | 271/274 |
| 5,620,174 | A * | 4/1997 | Taniguro et al. | 271/10.12 |
| 5,734,404 | A * | 3/1998 | Komuro et al. | 347/104 |
| 5,884,909 | A * | 3/1999 | Umeda | 271/242 |
| 6,137,504 | A | 10/2000 | Kawai et al. | |
| 6,554,417 | B2 * | 4/2003 | Lin et al. | 347/104 |

FOREIGN PATENT DOCUMENTS

| | | |
|---|---|---|
| JP | A 6-56298 | 3/1994 |
| JP | A 6-328798 | 11/1994 |
| JP | A-09-226961 | 9/1997 |
| JP | A 2002-53241 | 2/2002 |
| JP | A 2002-120419 | 4/2002 |
| JP | A 2002-265089 | 9/2002 |

* cited by examiner

*Primary Examiner*—Patrick H Mackey
*Assistant Examiner*—Thomas A Morrison
(74) *Attorney, Agent, or Firm*—Oliff & Berridge, PLC

(57) ABSTRACT

A recording medium transport device has: a transport roller unit that nips a recording medium and transports it to a recording area, the transport roller unit including a transport roller and plural pinch rollers for nipping and transporting the recording medium; a pinch roller holder body that pivotally supports the plural pinch rollers to be pressed to the transport roller, the pinch roller holder body including a base part to be attached to a frame and plural support parts for supporting the pinch rollers respectively, the base part and the support parts being integrally formed and integrally connected to each other through thin coupling parts long in a width direction of the recording medium; and plural urging units provided on the support parts respectively for elastically urging a tip side of each of the support parts toward the transport roller.

23 Claims, 13 Drawing Sheets

RECORDING MEDIUM TRANSPORT DEVICE AND IMAGE FORMING APPARATUS

BACKGROUND OF THE INVENTION

1. Field of the Invention

The present invention relates to a recording medium transport device that nips and transports a recording medium, and an image forming apparatus including the recording medium transport device and a printing part.

2. Background Art

Conventionally, in an apparatus for forming an image by causing ink jetted from a nozzle of an ink-jet recording head to adhere to a recording medium, the recording medium is made to intermittently move (step feeding) in a sub-scanning direction every specified length, and during the stop of the intermittent movement, a carriage on which the recording head is mounted is moved in a main scanning direction, and an image is formed in every specified area.

In that case, an upstream side transport roller pair at a transport upstream side (hereinafter simply referred to as an upstream side) in a transport direction and a downstream side transport roller pair at a transport downstream side (hereinafter simply referred to as a downstream side) are disposed at both sides of the recording head, the recording medium is nipped by both the roller pairs, and both the roller pairs are intermittently driven to move the recording medium in a sub-scanning direction. Such a structure is disclosed in JP-A-6-56298 and JP-A-6-328798.

In JP-A-6-56298, plural pinch rollers as driven rollers in the upstream side transport roller pair are attached to one pinch roller holder made of synthetic resin at suitable intervals in its longitudinal direction (direction orthogonal to the transport direction of the recording medium). The pinch roller holder is rotatably coupled to a corresponding hole part of an upper guide through a chassis (frame) by a boss part, one end of a single pinch roller spring is supported by the pinch roller holder above the boss part, the other end of the pinch roller spring is supported by a spring receive part of the upper guide, and the plural pinch rollers are pressed to the peripheral surface of a transport roller as a driving side through the pinch roller holder. Accordingly there has been a problem that a suitable pressing force cannot be applied to each of the pinch rollers.

In order to solve this problem, in JP-A-6-328798, support shafts provided to protrude at both end parts of one pinch roller holder made of synthetic resin in a longitudinal direction (direction orthogonal to the transport direction of the recording medium) are rotatably supported by a chassis (frame), and the pinch rollers are attached to the pinch roller holder at suitable intervals. Then, plural torsion coil springs are disposed to the pinch roller holder from above at suitable intervals in the direction orthogonal to a paper passing direction, and the pinch rollers are pressed to the transport roller. Besides, a slit or a notch long in the paper passing direction is formed in the pinch roller holder between the adjacent pinch rollers.

SUMMARY OF THE INVENTION

However, in JP-A-6-328798, since the portion from the part of the tip side of the holder to which each of the pinch rollers is attached to the base part side of the pinch roller holder is a rigid body having high rigidity, even if the torsion coil spring applies the urging force at each place where each of the pinch rollers is attached, since the base part side of the single pinch roller holder is vertically rotatably supported to the chassis (frame), the whole of the single pinch roller holder presses the transport roller, and therefore, it has been difficult to apply the pressing forces of the respective pinch rollers independently from each other without interfering with the adjacent pinch rollers.

Besides, as described before, since the base side of the single pinch roller holder is vertically rotatably supported to the frame, there have been problems that the posture in which the pinch roller holder is mounted to the frame is not stabilized, and a subsequent assembling operation becomes complicated.

A recording medium transport device and an image forming apparatus using the same are disclosed herein, in which the assembly of a pinch roller holder body to a frame is easy, adjacent pinch rollers do not interfere with each other, and pressing forces of the respective pinch rollers can be applied independently from each other.

According to one aspect of the invention, a recording medium transport device includes: a transport roller unit that nips a recording medium and transports it to a recording area, the transport roller unit including a transport roller and plural pinch rollers for nipping and transporting the recording medium; a pinch roller holder body that pivotally supports the plural pinch rollers to be pressed to the transport roller, the pinch roller holder body including a base part to be attached to a frame and plural support parts for supporting the pinch rollers respectively, the base part and the support parts being integrally formed and integrally connected to each other through thin coupling parts long in a width direction of the recording medium; and plural urging units provided on the support parts respectively for elastically urging a tip side of each of the support parts toward the transport roller.

BRIEF DESCRIPTION OF THE DRAWINGS

The present invention may be more readily described with reference to the accompanying drawings.

DETAILED DESCRIPTION OF THE PREFERRED EMBODIMENTS

A preferred embodiment of the present invention will be described with reference to FIGS. 1 to 13. The embodiment of the invention is applied to a recording medium transport device 3 to a printing part using an ink-jet recording head 2 in a multifunction apparatus 1 having a facsimile function, a scanner function, a copying function and a printer function.

Figure 1:
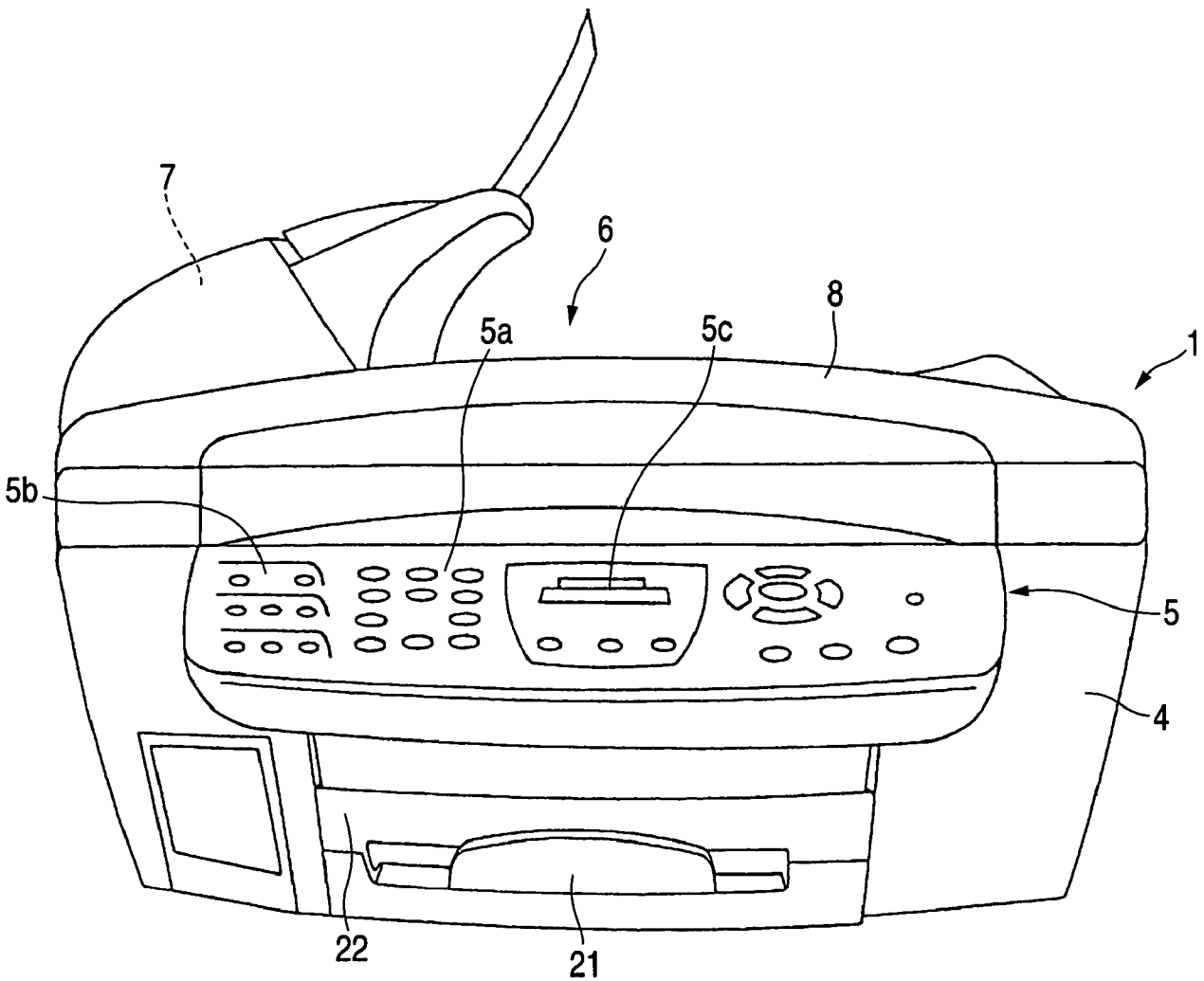
FIG. 1 is a whole front view of a multifunction apparatus.

As shown in FIG. 1, a front part of an upper surface in a main body case 4 of the multifunction apparatus 1 is provided with an operation panel part 5 including a ten-key pad 5*a* for executing the facsimile function, the scanner function and the copying function, a button key 5*b* for instructing various operations, a liquid crystal panel 5*c* and the like.

A document read device 6 provided on the upper surface of the main body case 4 and having an automatic paper feed device 7 includes a cover body 8 vertically rotatably mounted to a rear edge of the main body case 4 through a hinge (not shown), the automatic paper feed device 7 provided at one side of the upper surface of the cover body 8, a read element, such as a not-shown CIS (Contact Image Sensor), positioned at the lower side of an end glass plate (not shown) fixed to one end of the upper surface of the main body case 4, and the like. Incidentally, in this embodiment, in addition to the automatic paper feed reading performed in a state where the read element is stopped at the lower side of the automatic paper feed device 7 while a document is moved, such a structure is also adopted that a document is put on a large glass plate (not shown) disposed on the upper surface of the main body 4 while a surface on which an image is formed is oriented downward, and in a state where the document is pressed by a press body (not shown) such as a sponge provided at the under surface of the cover body 8, the read element reads the image according to image read instructions while moving on a guide rail disposed along the under surface of the large glass plate.

Figure 2:
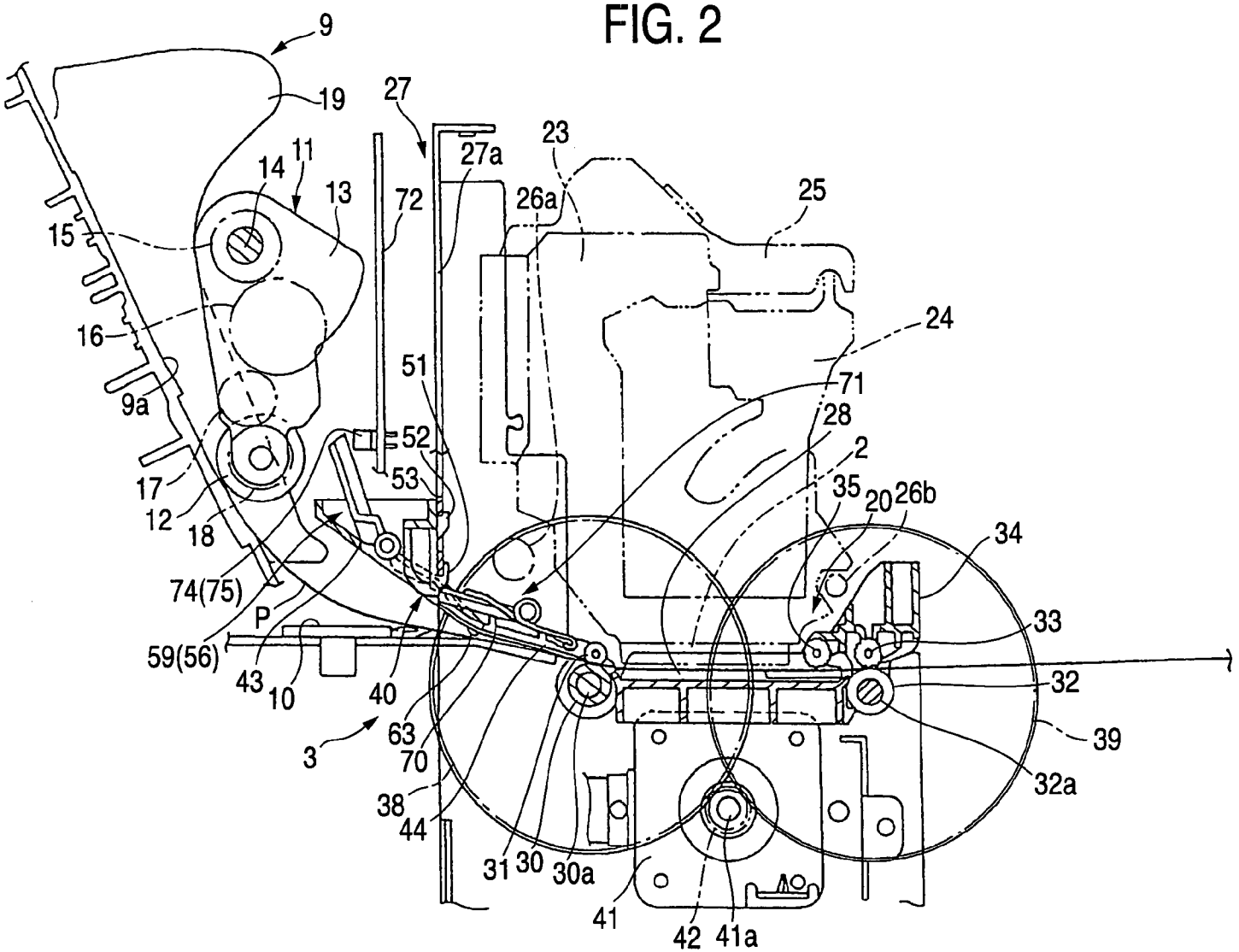
FIG. 2 is a side view of an ink-jet printing part and a recording medium transport device.

A paper feed part 9 is provided at the rear side of the main body case 4 and behind the cover body 8. As shown in FIG. 2, a paper feed tray 9*a* in the paper feed part 9 is disposed to be slanted downward and forward, and sheets P cut into a predetermined size as an example of recording media set in a stacked state are put on the paper feed tray 9*a* so that their lower end edges come in contact with a separating plate 10. At the surface side (front side) of the paper feed tray 9*a*, a case 13 of a paper feed roller unit 11 including a paper feed roller (pickup roller) 12 as a paper feed unit is rotatably mounted to a halfway part of a transmission shaft 14 in a longitudinal direction. In the case 13, there are disposed a drive gear 15 rotated integrally with the transmission shaft 14, a planetary gear 16 supported at the tip of a planetary arm (not shown) rotatably fitted to the transmission shaft 14 and engaging with the drive gear 15, an intermediate gear 17, and a gear 18 rotated integrally with the paper feed roller 12. Besides, although not shown, the case 13 is elastically urged by a torsion spring so that the paper feed roller 12 is pressed to the uppermost surface of the stacked sheets P.

Incidentally, a pair of sheet guide plates 19 (FIG. 2 shows only one of them) for guiding both the right and left side edges of the transported sheet P are mounted to the paper feed tray 9*a* to be horizontally movable in synchronization. Accordingly, in the paper feed tray 9*a*, the sheet P is transported by the recording medium transport device 3 in a state where its center in the width direction is coincident with the center position of an after-mentioned printing part 20 in the horizontal width. Further, at the front surface of the main body case 4, a paper output tray 21 for receiving a recording medium after an image is formed in the printing part 20 protrudes forward from an opening part 22.

Figure 3:
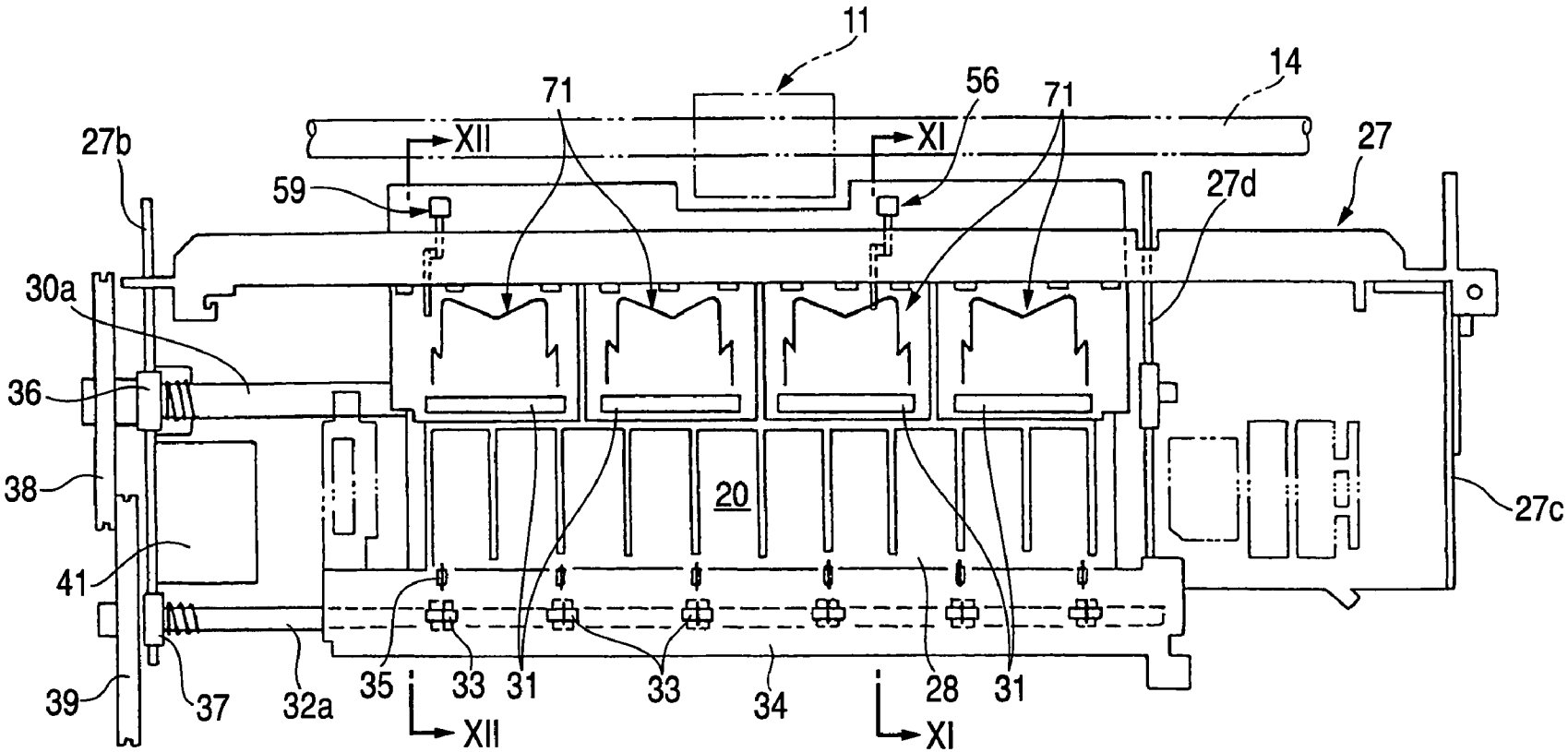
FIG. 3 is a plan view of the recording medium transport device.
Figure 4:
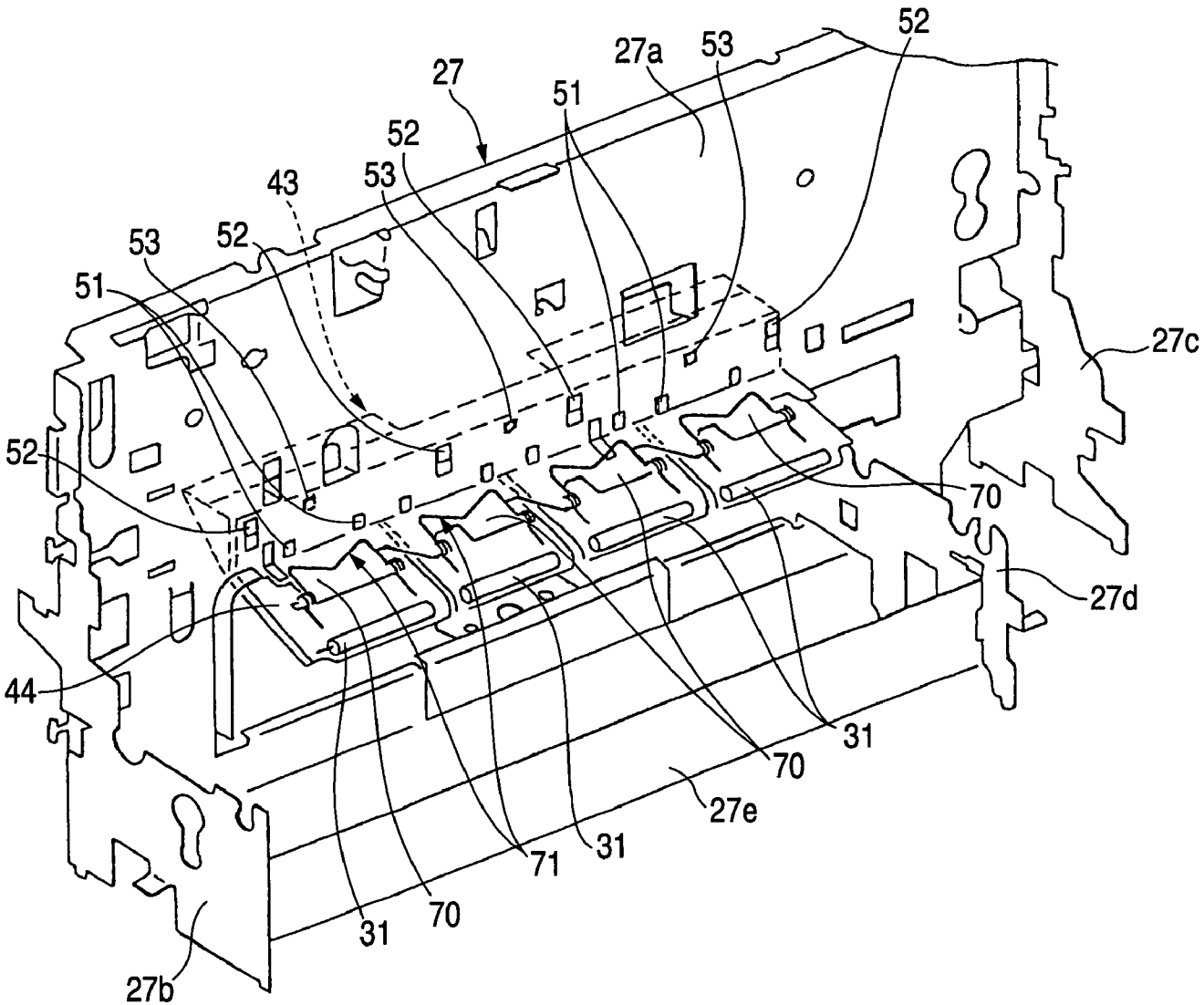
FIG. 4 is a front perspective view of the recording medium transport device in a state where it is mounted to a frame.
Figure 5:
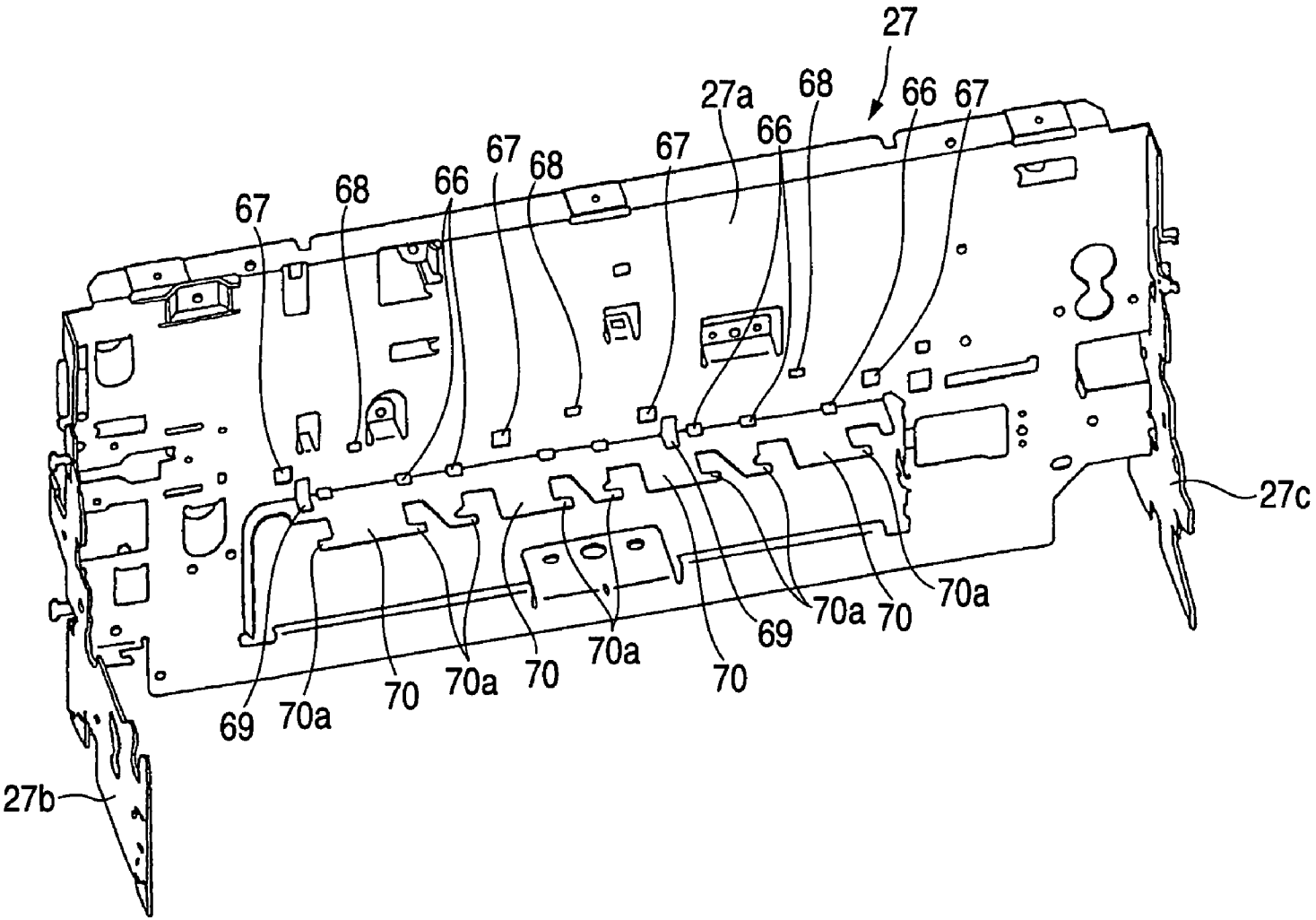
FIG. 5 is a front perspective view of the frame.

FIG. 2 is a side sectional view of the printing part 20 of the ink-jet recording head 2 and the recording medium transport device 3. The paper feed tray 9*a*, the paper feed roller unit 11, and the like are disposed at the transport upstream side of a frame 27 made of a metal plate and formed to be bent into a C shape when viewed on a plane as shown in FIGS. 3 to 5, and the after-mentioned printing part 20 and the recording medium transport device 3 are disposed at the transport downstream side thereof.

The frame 27 includes a main frame part 27*a* long along a width direction (also called a moving direction of a carriage or a main scanning direction, and the same shall apply hereinafter) of the sheet P, a side frame part 27*b* (27*c*) bent from both the right and left ends of the main frame 27*a* toward a transport direction (also called a sub-scanning direction, and the same shall apply hereinafter) of the sheet P and extending toward the downstream side in the transport direction, a side frame part 27*d* protruding, as a separate plate, from a halfway part of the main frame part 27*a* in the horizontal direction toward the downstream side in the transport direction, and a reinforcement part 27*e* for coupling the front end parts of the side frames 27*b* and 27*d* positioned at both the right and left sides (see FIGS. 4 and 5).

A carriage 23 is slidably mounted along two guide shafts 26*a* and 26*b* laid in a horizontal longitudinal direction between the pair of side frames 27*b* (27*d*). The recording head 2 of the color ink-jet cartridge type is mounted in the carriage 23 while its nozzle surface is oriented downward. Besides, ink cartridges 24 in which inks of respective colors of cyan, yellow, magenta and black are stored are detachably mounted on the upper surface of the recording head 2. Incidentally, the ink cartridge of each color is pressed downward and can be fixed by a lever 25 vertically rotatably provided at an upper end of the carriage 23.

The carriage 23 coupled with an endless timing belt (not shown) provided in parallel to the guide shaft 26*a* is constructed such that the carriage 23 can be reciprocated in the main scanning direction by the operation of a carriage motor (not shown) for driving the timing belt.

A platen 28 is disposed below the carriage 23 to face a nozzle surface of the recording head 2 and to extend in the main scanning direction.

Next, a structure of the recording medium transport device 3 will be described. In order to nip and intermittently transport the sheet P as the recording medium fed one by one from the paper feed roller 12 provided in the paper feed part 9 and the separating plate 10, the recording medium transport device 3 includes an upstream side transport roller pair 30, 31 as a first transport roller pair and a downstream side transport roller pair 32, 33 as a second transport roller pair. The upstream side roller pair 30, 31 are disposed at the upstream side of the platen 28, and the downstream side transport roller pair 32, 33 are disposed at the downstream side thereof.

Each of the drive roller 30 disposed at the lower side in the upstream side transport roller pair, and the drive roller 32 disposed at the lower side in the downstream side transport roller pair is one roller elongated in the main scanning direction. Then, a material having a large frictional coefficient, such as rubber, is coated around the outer periphery of each of round rod-like shafts 30*a* and 32*a* made of metal. Both end parts (FIG. 3 shows only one of them) of each of the shafts 30*a* and 32*a* are supported by the pair of side frame parts 27*b* (27*d*) through bearings 36 and 37 made of synthetic resin. A transmission gear 38 fixed to one end of the shaft 30*a* of the upstream side drive roller 30 and a transmission gear 39 fixed to one end of the shaft 32*a* of the downstream side drive roller 32 are constructed such that they are synchronized with each other through a pinion gear 42 attached to a motor shaft 41*a* of a transport motor 41 (see FIG. 3) and are rotated in the same direction (see FIGS. 2 and 3).

The pinch rollers 31 as driven rollers disposed at the upper side in the upstream side transport roller pair are disposed at suitable intervals in the main scanning direction on the upper surface of the drive roller 30. Each of the pinch rollers 31 is attached to an after-mentioned pinch roller holder body 40 as a support unit for supporting and capable of independently urging it.

On the other hand, on a sheet guide 34 disposed at the downstream side of the platen 28 and at an upper part and elongated in the main scanning direction, spur-type driven rollers 33 as shown in FIG. 2 are disposed at predetermined intervals in the main scanning direction. A mode may be such that the spur-type driven rollers 33 are individually urged by elastic springs and are pressed to the drive roller 32. Besides, on the sheet guide 34, plural auxiliary spurs 35 are disposed at the upstream side of the driven rollers 33 in the main scanning direction at suitable intervals (see FIGS. 2 and 3). The recorded sheet P smoothly passes through the lower surface side of the sheet guide 34 by this auxiliary spurs 35 and is guided toward positions between the spur-type driven rollers 33 and the drive roller 32.

Figure 6:
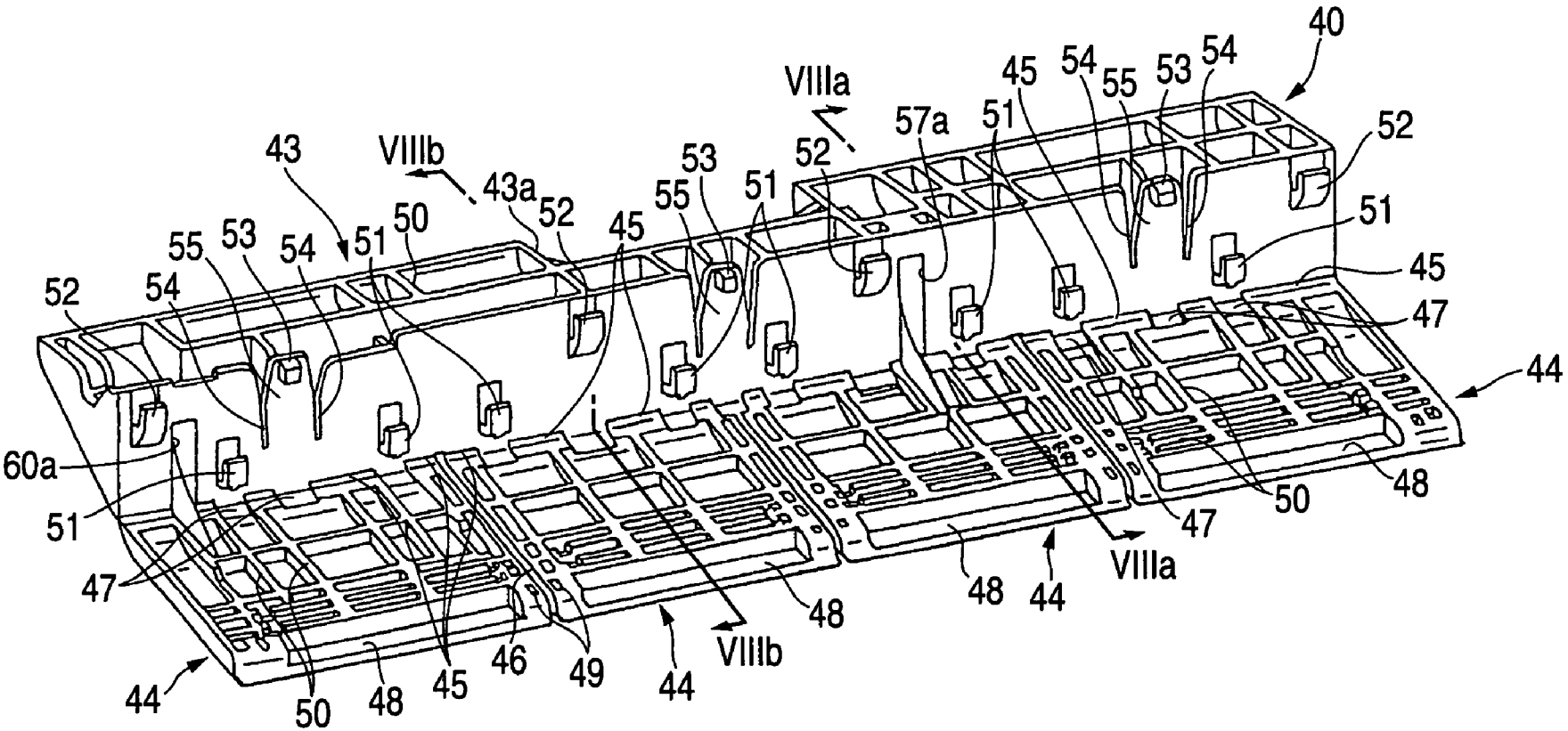
FIG. 6 is a perspective view of a pinch roller holder body.
Figure 7:
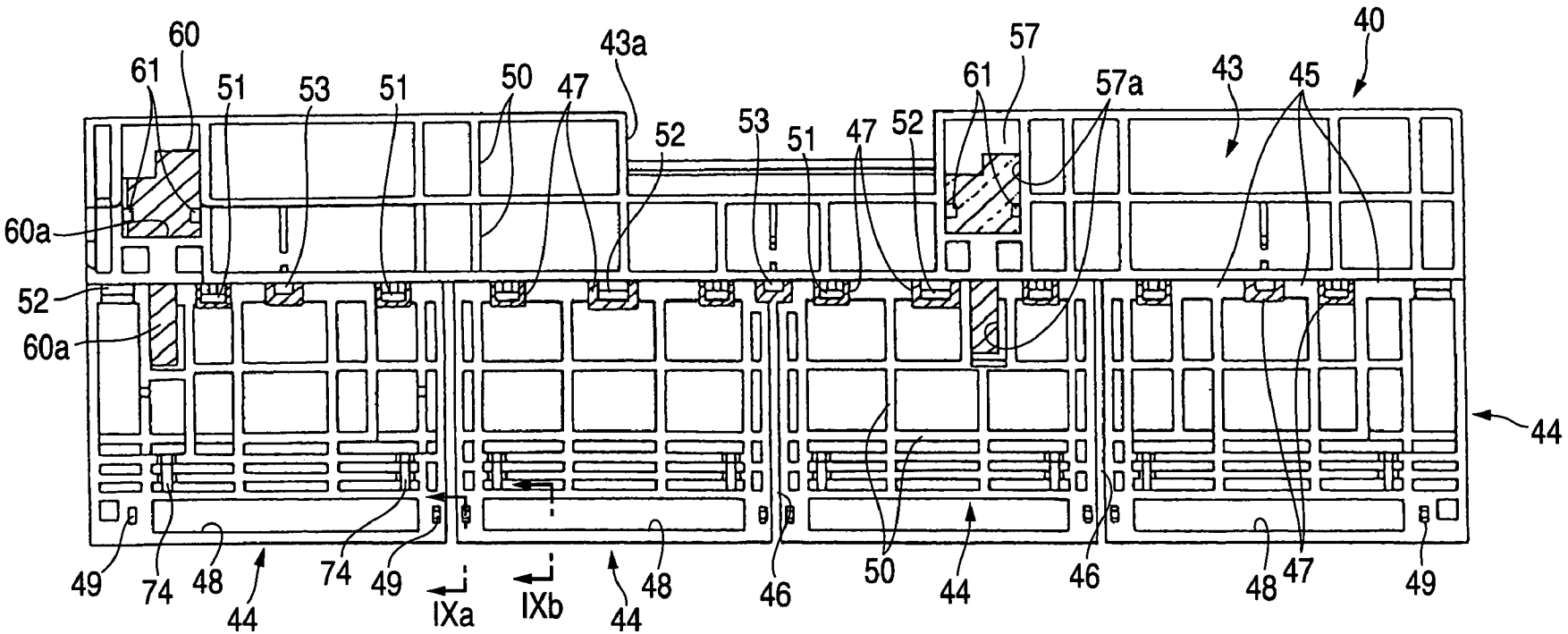
FIG. 7 is a plan view of the pinch roller holder body.
Figure 8A:
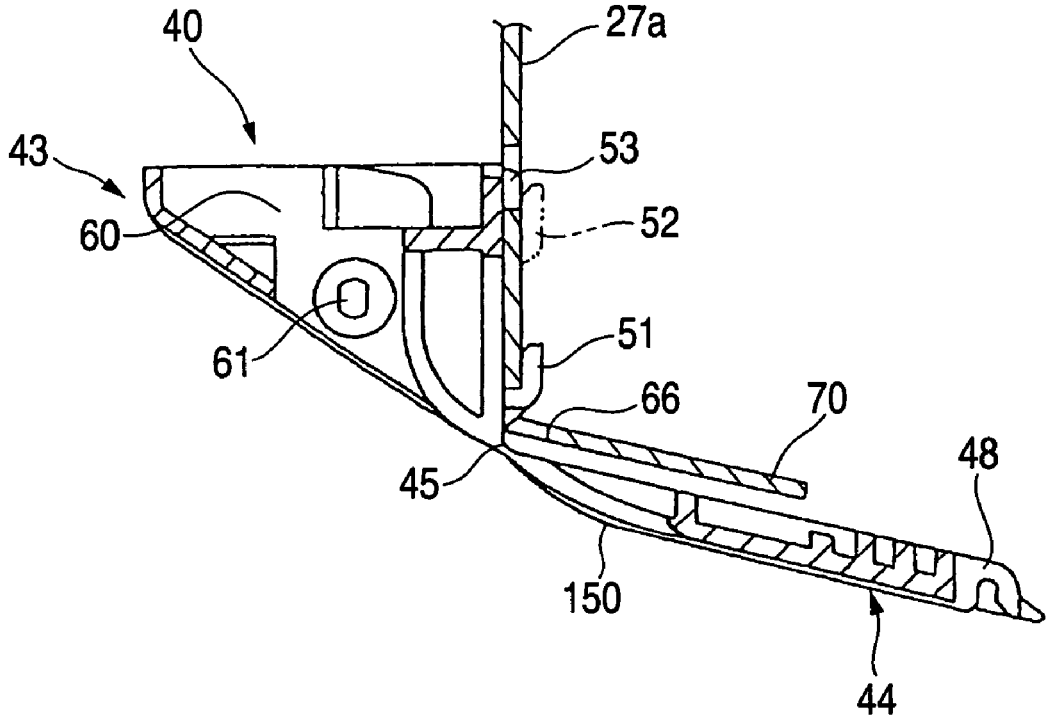
FIG. 8A is a sectional view taken along line VIIIa-VIIIa of FIG. 6.
Figure 8B:
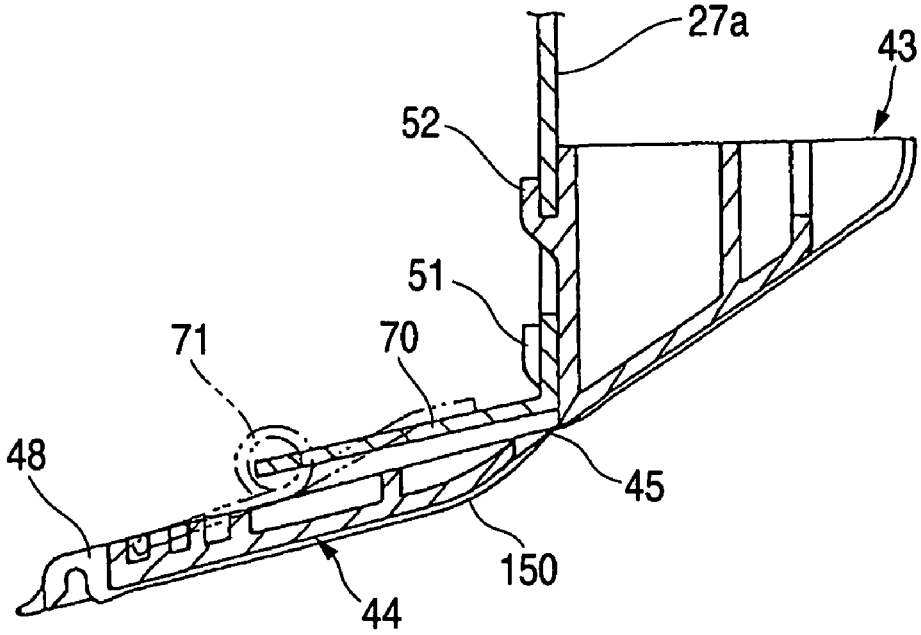
FIG. 8B is a sectional view taken along line VIIIb-VIIIb of FIG. 6.
Figure 9A:
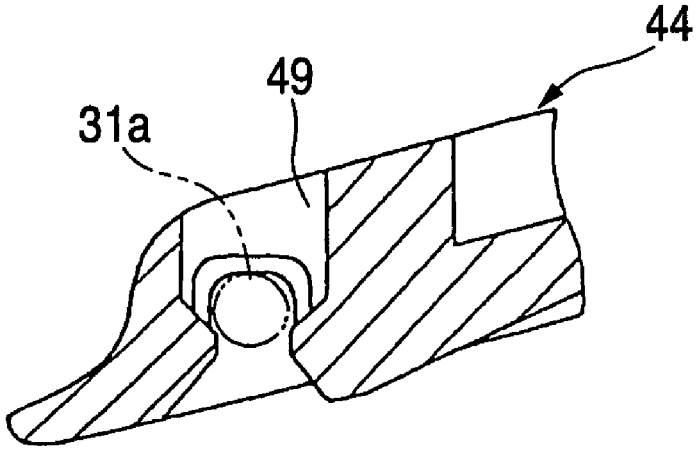
FIG. 9A is an enlarged sectional view taken along line IXa-IXa of FIG. 7.
Figure 9B:
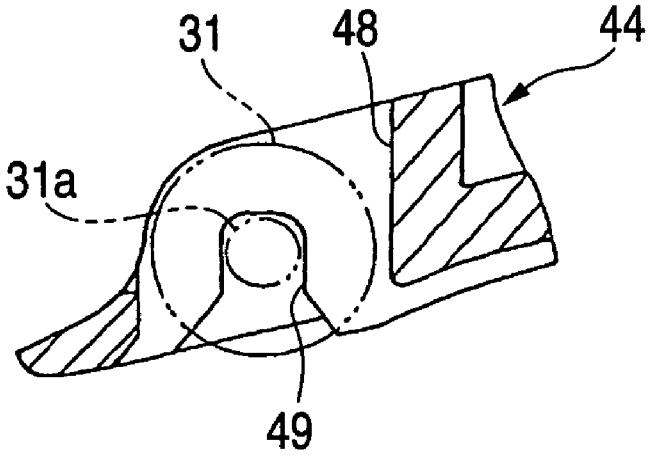
FIG. 9B is an enlarged sectional view taken along line IXb-IXb of FIG. 7.

The pinch roller holder body 40 made of synthetic resin such as POM (polyacetal resin) is such that a base part 43 elongated in the main scanning direction and support parts 44 for supporting the respective pinch rollers 31 are integrally molded by injection molding, and the respective support parts 44 are integrally connected to the one base part 43 by thin coupling parts 45 long in the width direction (main scanning direction) of the sheet P (see FIGS. 6 to 8). Further, in addition, in order that the pinch rollers 31 are disposed at symmetrical positions with respect to the center line of the sheet P in the width direction (main scanning direction), the respective support parts 44 are separated by slits 46 extending toward the downstream side in the sheet transport direction. Then, plural through holes 47 (see hatching parts in FIG. 7) are bored between the long thin coupling parts 45 as the root parts between the base part 43 and the respective support parts 44. By the thin coupling parts 45, the respective support parts 44 are constructed to be easily bent elastically and vertically with respect to the base part 43. Besides, by the existence of the through holes 47, the length of the thin coupling part 45 can be made shorter than the width size of each of the support parts 44, and the bending action can be improved.

At the tip part (the downstream side) of each of the support parts 44, there are formed a disposition hole 48 in which the pinch roller 31 is inserted from below, and attachment parts 49 which support a support shaft 31*a* protruding from both ends of the pinch roller 31 in such a manner that the support shaft can not fall off and is rotatable (see FIGS. 6, 7, 9 and 10). The base part 43 is basically formed to be a box having an open top or a frame, and the respective support parts 44 are basically formed to be flat plates. Further, plural (many) ribs 50 are integrally formed horizontally and vertically on the base part 43 and the support parts 44 in order to reduce weight and to raise rigidity. Moreover, at their bottoms, many ribs 150 (see FIG. 8, FIGS. 11 and 12 omit the illustration) extending in the sheet transport direction and for reducing contact resistance to the sheet P are provided at intervals in the width direction of the sheet P.

Then, upward first engagement hook parts 51, second hook parts 52 and substantially rectangular descending stop hooks 53 are integrally formed on the front surface of the base part 43, so that the main frame part 27*a* of the frame 27 can be positioned from the back side to produce inability to fall off and to produce inability to move in the vertical direction and the horizontal direction (see FIGS. 6, 7 and 8).

More particularly (in the embodiment), the two first engagement hook parts 51 (eight in total) are disposed for each of the support parts 44 at the lower part of a front plate 43*a* of the base part 43. The second engagement hook parts 52 are disposed at the upper part of the front plate 43*a* of the base part 43 and at four places in total, that is, at places near both the horizontal ends and near the center. The descending stop hook part 53 is integrally formed at the front surface of an elastic piece 55 formed between a pair of notch grooves 54 having open top in the front plate 43*a* of the base part 43. In the embodiment, the elastic pieces 55 are provided at three places in the horizontal direction of the base part 43 and at suitable intervals (see FIGS. 6 and 7).

Incidentally, in FIG. 7, the respective through holes 47 indicated by hatching correspond to the respective places of the first engagement hook parts 51, the second engagement hook parts 52, and the descending stop hook parts 53, are slightly larger than the shapes of the respective hook parts 51 to 53, and are substantially rectangular when viewed on a plane. The hook parts 51 to 53 and the through holes 47 are disposed as stated above, so that the respective hook parts 51 to 53 are integrally molded by a pair of metal molds at the time of injection molding of the pinch roller holder body 40.

Further, by changing the number, arrangement and the like of the hook parts 51 to 53 and the through holes 47, the strength of the thin coupling part 45 can be changed for each of the support parts 44. By this, even when a common urging spring body 71 is used, each of pressing forces of the pinch rollers 31 in the width direction (main scanning direction) of the sheet P can be suitably changed.

Besides, a shaft support part 57 and an insertion hole 57*a* for mounting a registration detection lever 56, which detects the leading end of the sheet P to be fed and transported and detects that the intermittently transported sheet P comes off from the nipping by the upstream side transport roller pair 30, 31, are formed to extend from the base part 43 of the pinch roller holder body 40 through the thin coupling part 45 to the support part 44 and substantially at the center part in the horizontal direction (center part in the main scanning direction). Then, a shaft support part 60 and an insertion hole 60*a* for mounting a width detection lever 59, which comes in contact with part of the sheet P in the width direction and detects the width of the sheet P, are formed at a position (side part) away from the center part of the base part 43 in the horizontal direction toward one side (see FIGS. 7, 8A, 11 and 12). The insertion holes 57*a* and 60*a* are indicated by hatching in FIG. 7.

In each of the shaft support parts 57 and 60, a pair of noncircular shafts 61 are provided to be opposite to each other so as to have a suitable gap at their free end sides (see FIGS. 7, 8, 11 and 12). On the other hand, an insertion groove 62*a* which can be fitted to the noncircular shafts 61 only when a contact part 63 side (lower end side) of each of the registration detection lever 56 and the width detection lever 59 is inserted to the insertion hole 57*a*, 60*a* in a direction orthogonal to the axial line of the noncircular shaft 61, is formed by cutting in a bearing tube part 62 formed at a halfway part of each of the registration detection lever 56 and the width detection lever 59 (see FIGS. 11, 12 and 13).

Figure 11:
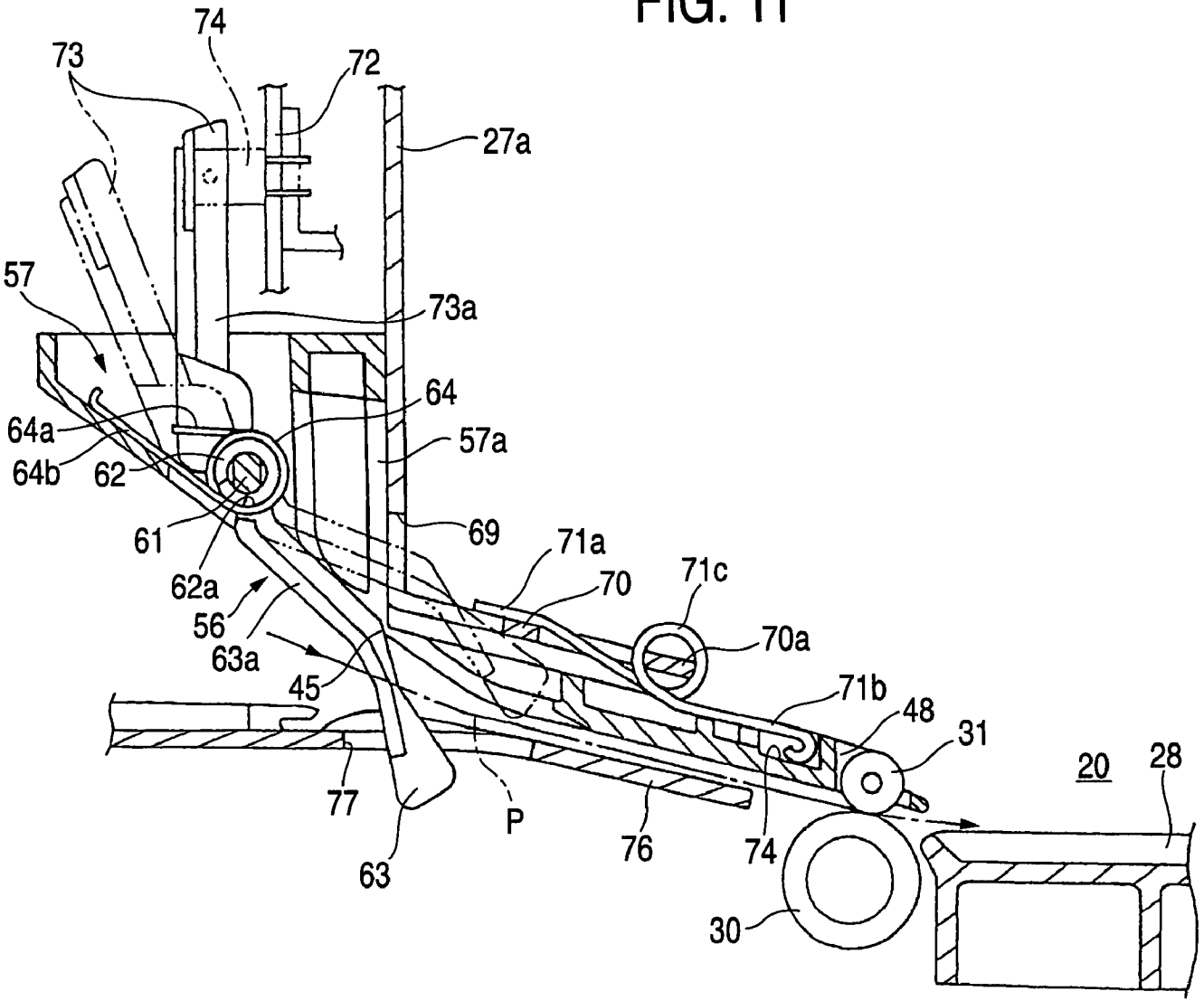
FIG. 11 is an enlarged sectional view taken along line XI-XI of FIG. 3.
Figure 12:
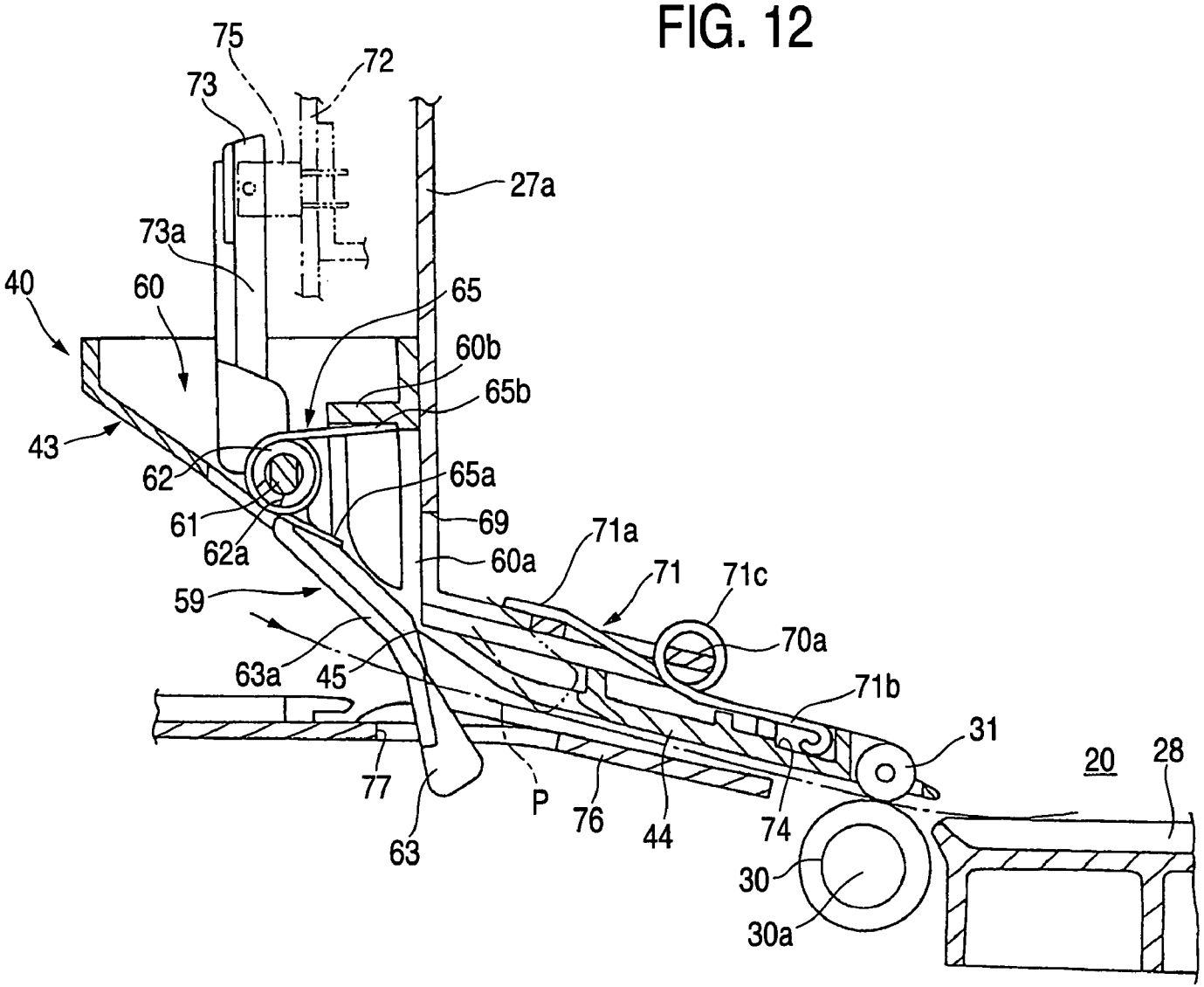
FIG. 12 is an enlarged sectional view taken along line XII-XII of FIG. 3.
Figure 13:
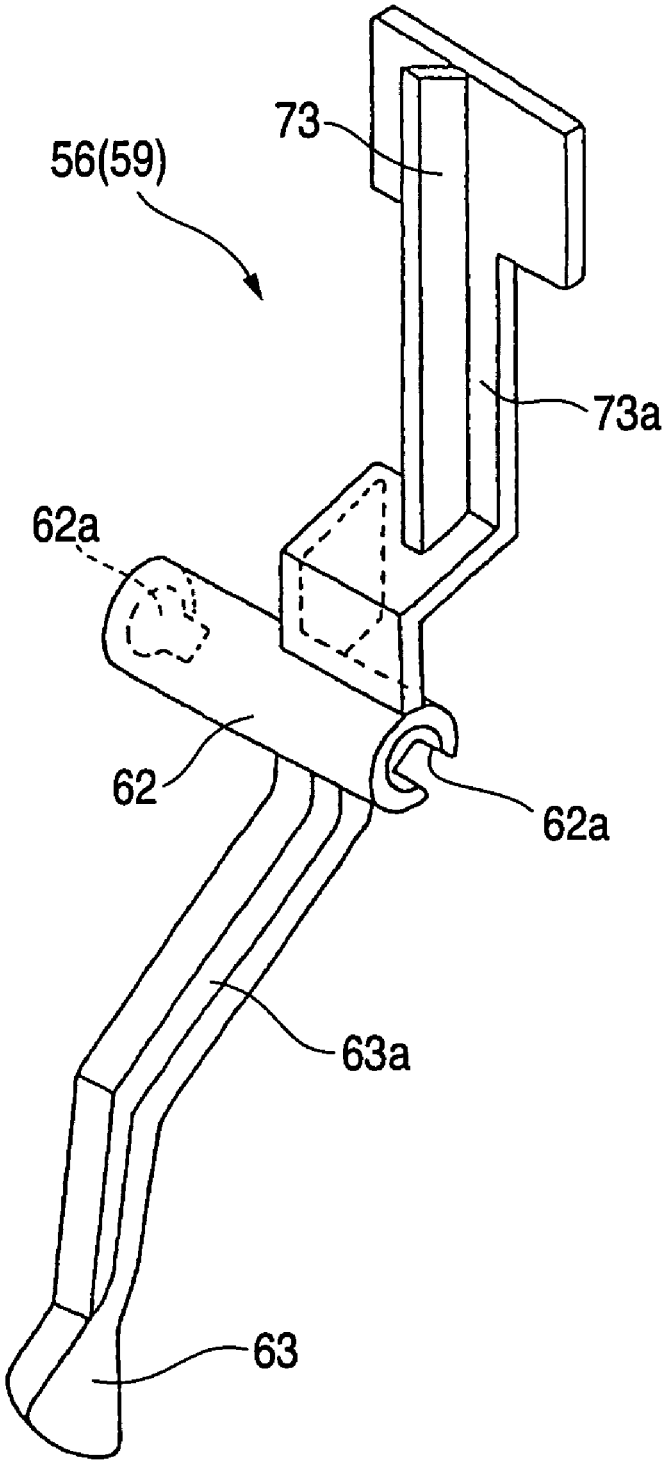
FIG. 13 is a perspective view of a registration detection lever and a width detection lever.

As shown in FIGS. 11 and 12, each of urging springs 64 and 65 for applying urging forces to the respective levers 56 and 59 has a winding part fitted to one side of the bearing tube part 62, a first engagement part extending from one side of the winding part is engaged with the registration detection lever 56 or the width detection lever 59, and a second engagement part extending from the other side of the winding part is engaged with the shaft support part 57, 60.

On the other hand, in the main frame part 27*a* of the frame 27, engagement holes 66, 67 and 68 are bored to correspond to the hook parts 51, 52 and 53 in the pinch roller holder body 40 (see FIG. 5). Besides, in the main frame part 27*a*, vertically long holes 69 are bored at positions corresponding to the places of the insertion holes 57*a* and 60*a* (see FIGS. 5, 11 and 12).

Incidentally, the horizontal width size of the engagement hole 67 corresponding to one (in this embodiment, the right end in FIGS. 3 to 5) of the plural second engagement hooks 52 is made coincident with the horizontal width of the corresponding second engagement hook part 52, so that as described later, a positioning function is achieved which makes horizontal movement impossible when the pinch roller holder body 40 is attached to the frame 27. Besides, at the lower end side of the main frame part 27*a*, spring support pieces 70 to cover the upper surfaces of the support parts 44 of the pinch roller holder body 40 substantially in parallel are integrally formed in a downward inclined shape toward the transport direction downstream side (see FIG. 5 etc.). Then, the engagement holes 66 corresponding to the first engagement hook parts 51 are formed in coupling root parts between the lower end of the main frame part 27*a* and the spring support pieces 70.

Besides, a vertical distance in the vertical direction from the upper edge of the engagement hole 66 to the lower side of the engagement hole 68 is set to be equal to a vertical distance in the vertical direction from the root part of the first engagement hook part 51 with open top to the lower surface of the descending stop hook part 53.

Incidentally, an urging spring body 71 for pressing the pinch roller 31 at the tip of each of the support parts 44 of the pinch roller holder body 40 toward the circumferential surface of the drive roller 30 is disposed astride the spring support piece 70 of the frame 27 and the support part 44, and the urging spring body 71 in the embodiment is formed such that one spring rod is bent and is integrally formed to be substantially M-shaped when viewed on a plane. In that case, one metal spring rod is bent so that the urging spring body 71 includes an M-shaped center part 71*a*, press foot parts 71*b* and 71*b* at both sides, and winding parts 71*c* at halfway parts of the respective press foot parts 71*b*.

Figure 10:
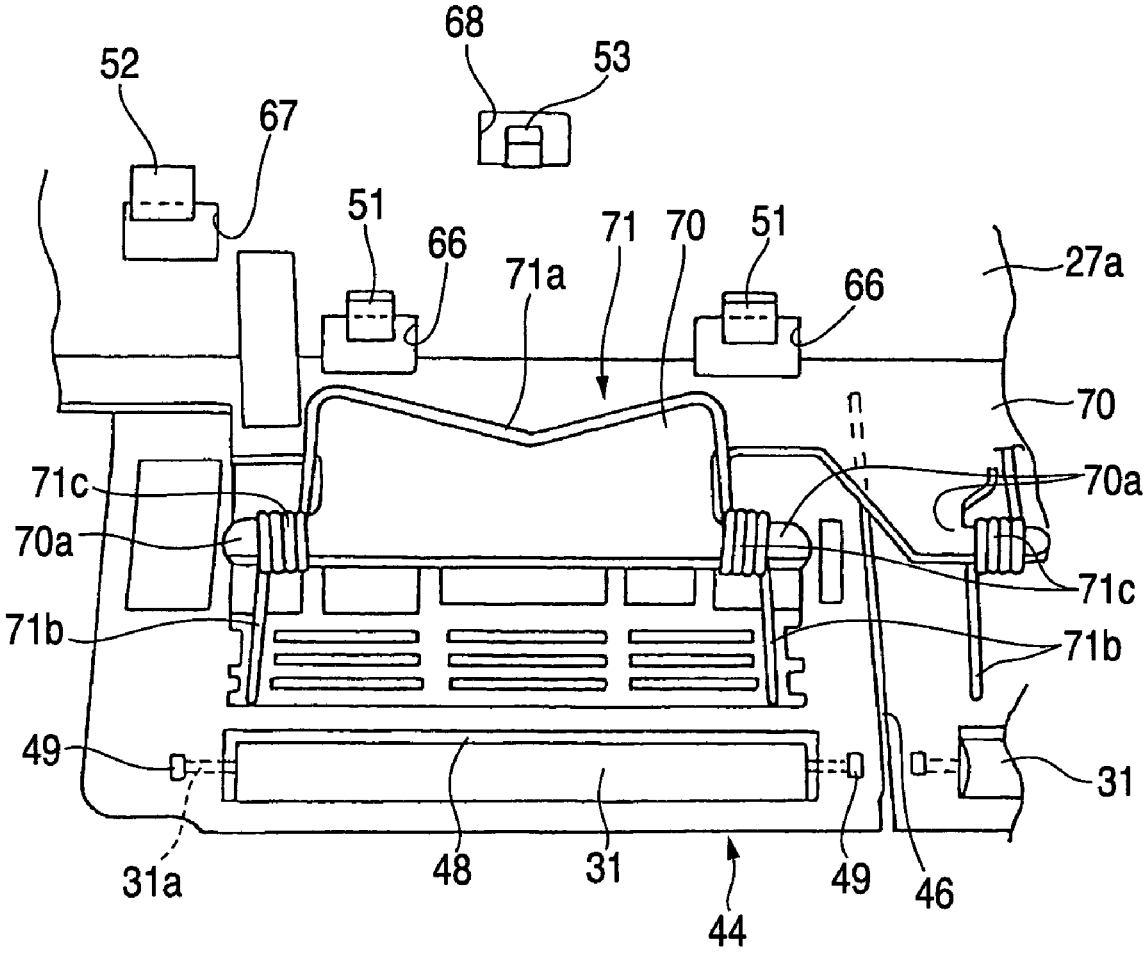
FIG. 10 is an enlarged view of a main part of FIG. 4.

Then, mount projection parts 71*a* to which the respective winding parts 71*c* are fitted in the horizontal direction (width direction of the recording medium) and can be supported are integrally formed at both end parts of each of the spring support pieces 70 at the free end side (see FIGS. 5 and 10). More particularly, as shown in FIGS. 4 and 5, only the mount projection part 70*a* positioned at the leftmost end protrudes in the left direction, and the other mount projection parts 70*a* are formed to protrude in the right direction.

A control substrate 72 is vertically provided at the rear surface side (upstream side in the transport direction) of the main frame part 27*a* in parallel thereto, and a registration sensor 74 and a width sensor 75, such as photo interrupters, for detecting the approach of the detected parts 73 at the upper end sides of the registration detection lever 56 and the width detection lever 59 by the interruption of light are fixed to the rear surface of this control substrate 72.

In a state (state where the rear edge of the sheet P has passed) in which the lower end (contact part 63) of the detection lever 56 (59) is fitted in a hole 77 of an upper surface of the guide plate 76, the base end side (detected part 73) of the detection lever 56 (59) enters the detection part of the registration sensor 74 (width sensor 75) and an OFF signal is outputted (see a solid line state of FIGS. 11-*and* 12). In a state where the leading edge of the sheet P presses up the contact part 63 of the detection lever 56 (59) and rotates it, the detected part 73 is separated from the registration sensor 74 (width sensor 75) and an ON signal is outputted (see a two-dot chain line state of FIG. 11).

In the above structure, in order to mount the pinch roller holder body 40 to the main frame part 27*a*, the front side of the base part 43 is made to approach upward from the lower end side of the main frame part 27*a*. Then, it is pressed up in a state where the respective lower first engagement hook parts 51 are fitted in the corresponding engagement holes 66, and the second engagement hook parts 52 are fitted in the corresponding engagement holes 67. At that time, since the descending stop hook part 53 protruding forward at the upper side of each of the upward elastic pieces 55 is pressed to the rear surface of the main frame part 27*a*, the upper end side (free end side) of the elastic piece 55 is elastically deformed by the reaction force so that it is separated from the rear surface of the main frame part 27*a*. Then, when the descending stop hook part 53 is fitted in the engagement hole 68, it can be fitted to the engagement hole 68 by the elastic force of the elastic piece 55 itself in a state where the lower end of each of the descending stop hook parts 53 is in contact with the lower edge of the engagement hole 68. At that time, the first engagement hook parts 51 respectively come in contact with the upper edges of the engagement holes 66, and the second engagement hook parts 52 respectively come in contact with the upper edges of the engagement holes 67. By this, the base part 43, that is, the pinch roller holder body 40 can not be moved vertically, and can be mounted to the main frame part 27*a* in the positioned state. Further, at this time, since the one second engagement hook part 52 and the engagement hole 67 are equal to each other in width size in the main scanning direction, the base part 43, that is, the pinch roller holder body 40 can not be moved also in the horizontal direction (main scanning direction), and the horizontal location is also positioned.

As stated above, the plural hook parts 51 to 53 are provided at the front surface of the base part 43, and when the respective hook parts are engaged with the engagement holes 66 to 68 bored in the main frame part 27*a* of the frame 27, there is obtained a merit that the attachment operation of the pinch roller holder body 40 to the frame can be performed through one-touch operation.

In this state, each of the support parts 44 is disposed almost along the lower surface of the spring support piece 70 extending in the oblique down direction (direction to approach the upper surface of the drive roller 30) from the lower end of the main frame part 27*a*, and the pinch roller 31 at the tip of each of the support parts 44 approaches the upper surface of the drive roller 30. Next, the center part 71*a* of each of the urging spring bodies 71 is put on the upper surface of each of the spring support pieces 70, and when the winding parts 71*c* are fitted to the mount projection parts 71*a* of each of the spring support pieces 70, the press foot parts 71 at both the sides of the urging spring body 71 are disposed on the upper surface of the support part 44 so as to extend in the tip direction. Then, a round part of the tip (free end) of the press foot part 71*b* is fitted in an engagement recess part 74 (see FIGS. 7, 11 and 12) concavely formed in the upper surface of each of the support parts 44 and at the side part near the tip.

Thus, each of the support parts 44 is coupled with the base part 43 through the thin coupling part 45, and each of the urging spring bodies 71 applies the urging force, so that the pinch roller 31 at the tip side of each of the support parts 44 is independently pressed and urged to the upper surface of the drive roller 30.

Besides, with respect to each of the urging spring bodies 71, the tip round part of the press foot part 71*b* is first fitted in the engagement recess part 74, and then, the winding part 71*c* may be fitted to the mount projection part 71*a*. For example, the respective right and left tip round parts may be fitted at the same time, or while the tip round part at one of the right and left sides is fitted in the engagement recess part 74, the winding part 71*c* is fitted to the mount projection part 70*a*, and then, the center part (M-shaped portion) 71*a* mounted on the upper surface of the spring support piece 70 is operated to push and open it toward the outside or inside against the elasticity, and while the winding part 71*c* at the other side is fitted to the mount projection part 71*a*, the tip round part may be fitted in the engagement recess part 74.

At this time, with respect to each of the urging spring bodies 71, since the center part 71*a* coupling the pair of left and right press foot parts 71*a* is formed to be bent like the M shape, when the winding parts 71*c* are fitted to the mount projection parts 70*a*, the push opening operation in the fitted direction becomes very easy.

Accordingly, especially in the embodiment shown in FIGS. 4 and 5, since only the leftmost mount projection part 70*a* is formed to protrude in the left direction, at the time of mounting of the urging spring body 71 corresponding to this, it is necessary that the press foot part 71*a* is operated to be press opened outward, and the winding part 71*c* is fitted to the mount projection part 71*a*, however, there is no fear that the attachment operation becomes difficult by this.

When the leftmost mount projection part 70*a* is also made to protrude in the right direction, a projection piece for the formation of a mount projection part is newly required at the outside (left side) of the left end spring support piece 70 shown in FIG. 5, and by that, a large opening (space corresponding to a transport path of the recording medium) must be formed in the frame, and accordingly, there is a fear that the strength of the frame is lowered. However, in this embodiment, there is no such fear.

Incidentally, the registration detection lever 56 and the width detection lever 59 are mounted at a stage before the pinch roller holder body 40 is mounted to the frame 27.

That is, in the state (see FIGS. 11 and 12) where the registration detection lever 56 and the width detection lever 59 are mounted to the pinch roller holder body 40, the contact part 63 of each of the detection levers 56 and 59 comes in contact with part of the spring support piece 70, and further rotation is restricted, and therefore, the bearing tube part 62 can not rotate up to the position (position where the insertion groove 62*a* corresponds to the thin width portion of the noncircular shaft 61) where it can be separated from the noncircular shaft 61. By this, sudden separation of the respective levers 56 and 59 in the mounted state can be certainly prevented.

However, within a normal operation range of the respective levers 56 and 59 in the mounted state, that is, within a range where the respective levers 56 and 59 are rotated by the contact with the sheet P, when at least the condition that the insertion groove 62*a* does not correspond to the thin width portion of the noncircular shaft 61 is satisfied, the respective levers 56 and 59 may be attached after the pinch roller holder body 40 is mounted to the frame 27.

Then, when an image formation (printer) instruction is issued by a button operation of the operation panel part 5, one of the sheets P stacked on the paper feed part 7 is fed by the rotation of the paper feed roller 12, and the leading end of the sheet P is separated from the stacked place at the place of the separating plate 10, and is transported to the upstream side transport roller pair 30, 31 along the upper surface of the guide plate 76. In this state, the drive roller 30 is in a still state.

Next, the center leading edge of the sheet P in the width direction pushes up the registration detection lever 56, and the registration sensor 74 outputs the ON signal. The signal is received and the sheet P is transported until the leading edge of the sheet P runs against (collides with) the part (nip part) between the drive roller 30 and the pinch roller 31, and after the leading edge of the sheet P is aligned to become parallel to the main scanning direction at the nip part, driving of the transport motor 41 is started.

By this, the leading end of the sheet P is nipped between the pinch roller 31 and the drive roller 30, and the drive roller 30 and the downstream side drive roller 32 are intermittently driven in synchronization with each other.

Lines of nozzles (not shown) for jetting ink droplets are provided in the recording head 2 and in the sub-scanning direction, and the recording head 2 performs printing in the predetermined print width while moving in the main scanning direction along the guide shafts 26*a* and 26*b*. The drive roller 30 and the drive roller 32 are stopped during the time when the recording head 2 moves in the main scanning direction and performs printing, and the movement of the recording head 2 and the driving of the drive roller 30 and the drive roller 32 are alternately performed, and accordingly, the driving of the drive roller 30 and the drive roller 32 is intermittently performed. By plural intermittent rotations, the transported sheet P is ejected to the front paper output tray 21 of the multifunction apparatus 1.

Incidentally, when an air suction unit (not shown) is connected to the platen 28, and the sheet P is sucked to the upper surface of the platen 28 during jetting of ink, there is obtained an effect that. an interval between the sheet P and the nozzle surface of the recording head 2 can be held constant.

After a stage where the leading end of the sheet P is nipped between the downstream side transport roller pair 32, 33, although the transport speed by the downstream side transport roller pair 32, 33 is synchronized to be slightly faster than the transport speed by the transport upstream side roller pair 30, 31, since the nipping force of the downstream side transport roller pair 32, 33 is lower than the nipping force of the transport upstream side roller pair 30, 31, even if both the drive rollers 30 and 32 are driven in synchronization, the sheet P is slightly slipped at the nip part of the downstream side transport roller pair 32, 33, and the flatness of the sheet P on the platen 28 is held.

In this embodiment, the plural support parts 44 in the pinch roller holder body 40 are integrally coupled to the base part 43 long in the main scanning direction through the thin coupling parts 45 so that the support parts, together with the pinch rollers at the tip of the supports, are independently vertically swung, and the respective support parts 44 are independently urged by the corresponding urging spring bodies 71. Accordingly, in the case where the plural pinch rollers 31 are disposed at each of symmetrical positions of both sides of the width direction center of the sheet P in the direction orthogonal to the transport direction, the urging forces by the urging spring bodies 71 are suitably applied to the pinch rollers 31 respectively, and oblique movement of the sheet P transported by the downstream side transport roller pair 32, 33 can be more decreased.

As described above in detail, the recording medium transport device 3 according to this embodiment includes the transport roller unit for nipping the recording medium P and transporting it to the recording area, in which the transport roller unit includes the transport roller 30 and the pinch rollers 31 for nipping and transporting the recording medium, the pinch roller holder body 40 for pivotally supporting the plural pinch rollers 31 pressed to the transport roller 30 includes the base part 43 attached to the frame 27 and the plural support parts 44 for supporting the pinch rollers 31 respectively, which are integrally molded, the base part 43 and the respective support parts 44 are integrally connected to each other through the thin coupling parts 45 long in the width direction of the recording medium, and each of the support parts 44 includes the urging unit for elastically urging the tip side of each of the support parts 44 toward the transport roller 30.

As stated above, since the pinch roller holder body 40 is such that the base part 43 elongating in the main scanning direction and the respective support parts 44 for supporting the pinch rollers 31 respectively are integrally molded of synthetic resin or the like by injection molding, the number of parts is decreased, and since the one base plate has only to be mounted to the frame 27, as compared with the labor of mounting support parts to the frame at respective places where pinch rollers are mounted, the assembling operation can be greatly simplified.

Then, since the respective support parts 44 are integrally connected to the one base part 43 through the thin coupling parts 45 long in the width direction of the recording medium, the respective support parts 44 can be elastically vertically easily bent with respect to the base part 43 by the thin coupling parts 45, and there is obtained an effect that a certain nipping operation can be given in accordance with the width of the recording medium to be transported.

According to this embodiment, in the pinch roller holder body 40, the support parts 44 are integrally molded with the base part 43 which is attached to the back surface of the standing wall of the frame 27, and are substantially horizontal or are inclined slightly downward toward the downstream side in the sheet transport direction. Accordingly, in addition to the above-described effect, there are effects that the pinch roller holder body 40 having an almost L-shaped cross section can be easily attached to the frame 27 from its back side, and the transport device 3 can be made compact.

According to this embodiment, in the recording medium transport device 3, the through holes 47 are provided in each of the coupling parts 45, and the hook parts 51, 52, 53 detachably attached to the frame are integrally molded with the base part 43 corresponding to the through holes 47. Accordingly, in addition to the above-described effects, the length of each of the thin coupling parts 45 can be made shorter than the width size of each of the support parts 44 by the existence of the through holes 47, and the bending operation can be improved. Then, in the case where the hook parts 51, 52, 53 detachably attached to the frame 27 are integrally molded with the base part 43, since the positions of the through holes 47 are made the positions corresponding to the hook parts 51, 52, 53, the respective hook parts can be integrally molded by a pair of metal molds at the time of integral molding of the pinch roller holder body 40, and it is not necessary to use complicated metal molds.

According to this embodiment, in the recording medium transport device 3, the plural hook parts 51, 52, 53 are disposed at intervals in the direction crossing the transport direction of the recording medium, and the frame 27 includes the engagement holes in which, when the base part 43 is inserted from the lower end side of the back surface, positioning of the pinch roller holder body 40 in the vertical direction is made by the upward engagement hook parts and the ascending stop engagement hook parts, and the positioning hole in which positioning of the pinch roller holder body 40 in the horizontal direction is made by at least one of the engagement hook parts. Accordingly, there are obtained effects that after the base part 43 is mounted to the frame 27, the pinch roller holder body is not shifted horizontally and vertically, the adjusting operation of attachment positions become unnecessary, and the assembling operation becomes very easy.

According to this embodiment, in the recording medium transport device 3, the urging spring body 71 for press urging the support part 44 in the direction toward the transport roller 30 is provided as the urging unit astride the frame 27 and each of the support parts 44 of the pinch roller holder body 40. Accordingly, in addition to the above-described effects, a post-attachment operation of mounting the urging spring body 71 after the pinch roller holder body 40 is mounted to the frame 27 can be easily performed. Besides, it becomes easy that the urging spring bodies 71 are separately formed so that the urging forces are changed for the respective support parts 44 as the need arises.

According to this embodiment, in the recording medium transport device 3, the spring support piece 70 along the upper surface of each of the support parts 44 is integrally formed at the lower end of the frame 27, the urging spring body 71 is formed to be substantially M shaped when viewed on a plane, the press foot parts extending from the left and right ends of the urging spring body 71 press the support part 44, and the winding part fitted to the mount projection part formed at the spring support piece is integrally formed at the halfway part of each of the press foot parts. When the M-shaped urging spring body 71 is used for the spring support piece of the form as stated above, there is obtained an effect that the mounting operation becomes very easy.

According to this embodiment, in the recording medium transport device 3, the mount projection part formed at the spring support piece is formed to protrude in the width direction of the recording medium. Accordingly, there are effects that by the simple operation of fitting the right and left winding parts of each of the urging spring bodies 71 laterally to the mount projection parts, the attachment can be performed easily and quickly, and further, the press foot part extending from each of the winding parts can be certainly brought into elastic contact with the support part 44 of the pinch roller holder body 40.

According to this embodiment, in the recording medium transport device 3, only one of the mount projection parts positioned at one side in the width direction of the recording medium is formed to project in an opposite direction to the other ones. Accordingly, there is an effect that as compared with the case where all mount projection parts are formed to project in the same direction, the length of the spring support pieces over the whole area in the width direction can be made short.

According to this embodiment, the platen facing the nozzle surface of the ink-jet recording head is disposed at the downstream side in the transport of the recording medium with respect to the transport roller unit. When the structure as stated above is adopted, there are obtained effects that the assembling operation of the ink-jet image forming apparatus is simplified, and the low-cost apparatus can be provided.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A recording medium transport device comprising:

a transport roller unit that nips a recording medium and transports the recording medium in a recording medium transport direction to a recording area, the transport roller unit including:

a transport roller and plural pinch rollers for nipping and transporting the recording medium;

an integrally formed pinch roller holder body that pivotally supports the plural pinch rollers to be pressed to the transport roller, the pinch roller holder body including:

a base portion that is immovably fixed to a frame;

plural support portions for supporting the plural pinch rollers respectively; plural intermediate portions located between the base portion and each of the plural support portions, each of the plural intermediate portions being smaller in thickness than the base portion and each of the plural support portions and elongating in a direction orthogonal to the recording medium transport direction; and plural urging units directly contacting the plural support portions respectively for elastically urging a tip side of each of the plural support portions toward the transport roller.

2. The recording medium transport device according to claim 1, wherein the plural support portions are integrally formed with the base portion to be attached to a back surface of a standing wall of the frame, and are substantially horizontal or are inclined slightly downward toward a downstream side in a recording medium transport direction.

3. The recording medium transport device according to claim 1, wherein through holes are provided in each of the plural intermediate portions, and plural hook portions to be attached to the frame detachably are integrally formed with the base portion which are corresponding to the through holes.

4. The recording medium transport device according to claim 3, wherein the plural hook portions including plural upward engagement hook portion and an ascending stop engagement hook portion are disposed at intervals in a direction crossing a recording medium transport direction; and when the base portion is inserted from a lower end side of a back surface of the frame, positioning of the pinch roller holder body in a vertical direction is made by inserting the upward engagement hook portions and ascending stop engagement hook portions into engagement holes formed in the frame, and positioning of the pinch roller holder body in a horizontal direction is made by inserting at least one of the upward engagement hook portions into a positioning hole formed in the frame.

5. The recording medium transport device according to claim 1, wherein an urging spring body for press urging a respective one of the plural support portions in a direction toward the transport roller is provided as each of the plural urging units, each of the urging spring bodies astride the frame and a respective one of the plural support portions of the pinch roller holder body.

6. The recording medium transport device according to claim 5, wherein spring support pieces along an upper surface of each of the plural support portions are integrally formed on the frame, each of the urging spring bodies is formed to be substantially M shaped when viewed on a plane, press foot portions extending from right and left ends of the urging spring body press a respective one of the plural support portions, and respective winding portions fitted to mount projection portions formed at each of the spring support pieces are integrally formed at halfway portions of each of the press foot portions.

7. The recording medium transport device according to claim 6, wherein the mount projection portions formed at each of the spring support pieces is formed to protrude in the width direction of the recording medium.

8. The recording medium transport device according to claim 7, wherein one of the mount projection portions positioned at one side in the width direction of the recording medium is formed to project in an opposite direction to the another one of the mount projection portions.

9. An image forming apparatus comprising:

a recording medium transport device; and a platen disposed to face a nozzle surface of an ink-jet recording head at a downstream side in a recording medium transport direction;

wherein the recording medium transport device comprises:

a transport roller unit that nips a recording medium and transports the recording medium in a recording medium transport direction to a recording area, the transport roller unit including a transport roller and plural pinch rollers for nipping and transporting the recording medium;

an integrally formed pinch roller holder body that pivotally supports the plural pinch rollers to be pressed to the transport roller, the pinch roller holder body including;

a base portion that is immovably fixed to a frame;

plural support portions for supporting the plural pinch rollers respectively; plural intermediate portions located between the base portion and the support portions, the intermediate portions being smaller in thickness than the base portion and the support portions and elongating in a direction orthogonal to the recording medium transport direction; and plural urging units directly contacting the plural support portions respectively for elastically urging a tip side of each of the plural support portions toward the transport roller.

10. An image forming apparatus comprising:

a transport roller unit that nips a recording medium and transports it to a recording area, the transport roller unit including a transport roller and plural pinch rollers;

a frame including a standing wall disposed at an upstream side of the transport roller unit in a recording medium transport direction and plural spring support pieces, each individually and separately extending from the standing wall to a downstream side in the recording medium transport direction;

a pinch roller holder body including a base portion to be attached to the standing wall and plural support portions extending from the base portion to the downstream side along a lower surface of the plural spring support pieces respectively and supporting the plural pinch rollers respectively; and an urging spring body including a pair of press foot portions and a center portion connecting the press foot portions, the urging spring body being astride the plural spring support pieces and one of the plural support portions to press one of the plural support portions toward the transport roller by the press foot portions.

11. The image forming apparatus according to claim 10, wherein the plural spring support pieces each include mount projection portions on both end portions thereof in a width direction orthogonal to the recording medium transport direction, and the urging spring body includes winding portions to be fitted to the mount projection portions on the press foot portions respectively.

12. The image forming apparatus according to claim 10, wherein the center portion of the urging spring body connects one end of the pair of press foot portions, and an interval between the other end of the press foot portions is larger than that between the one end of the press foot portions.

13. The image forming apparatus according to claim 11, wherein an interval between the pair of press foot portions on one side with respect to the winding portions is smaller than that on the other side with respect to the winding portions.

14. The recording medium transport device according to claim 1, wherein the pinch roller holder body has a substantially L-shape having a bent portion as viewed in the direction orthogonal to the recording medium transport direction, and wherein the plural intermediate portions are located at the bent portion.

15. The recording medium transport device according to claim 1, wherein each of the plural urging units has a spring supported by the frame at first positions, and wherein a distance between an axis of each pinch roller and respective one of the first positions is smaller than a distance between the axis of each the plural pinch rollers and respective one of the plural intermediate portions.

16. The recording medium transport device according to claim 10, wherein the urging spring body is supported by the plural spring support pieces at first positions, and wherein a distance between an axis of each of the plural pinch rollers and respective ones of the first positions is smaller than a distance between the axis of each the plural pinch rollers and respective ones of positions from which the plural support portions extend.

17. A recording medium transport device comprising:

a transport roller supported by a frame;

a holder having a fixed end, a plurality of free ends and a plurality of extending portions each extending between the fixed end and a respective one of the plurality of free ends, and the fixed end being immovably fixed to the frame, each of the plurality of extending portions having a thickness-reduced portion being smaller in thickness than the fixed end and a respective one of the plurality of free ends;

a plurality of pinch rollers each supported by a respective one of the plurality of free ends;

a plurality of springs directly contacting and urging the extending portions at first positions between the thickness-reduced portions and the free ends to thereby urge the plurality of pinch rollers toward the transport roller.

18. The recording medium transport device according to claim 17, wherein each of the thickness-reduced portions is formed of a groove elongating in a direction substantially parallel to a rotating axis of the plurality of pinch rollers.

19. The recording medium transport device according to claim 17, wherein the holder presents an L-shape having a bent portion at the thickness-reduced portions as viewed in a direction parallel to the rotating axis of the plurality of pinch rollers.

20. The recording medium transport device according to claim 1, wherein the plural urging units urge the tip sides of each of the plural support portions at positions between the plural support portions and the base portion.

21. The recording medium transport device according to claim 1, wherein a part of the plural urging units is supported on the frame to urge the plural support portions toward the transport roller.

22. The image forming apparatus according to claim 9, wherein a part of the plural urging units is supported on the frame to urge the plural support portions toward the transport roller.

23. The recording medium transport device according to claim 19, wherein a part of the plurality of springs is supported on the frame to urge the extending portions toward the transport roller.

* * * * *